US005257777A

United States Patent [19]

Kalika et al.

[11] Patent Number: 5,257,777

[45] Date of Patent: Nov. 2, 1993

[54] BELT SEPARATOR FOR DOCUMENT SINGULATION

[76] Inventors: Joseph Kalika, 8803 Grand, Niles, Ill. 60648; George Rabindran, 8900 Marmora, Morton Grove, Ill. 60053; Thomas Faber, 7852 Kedvale, Skokie, Ill. 60076; Kenneth L. Guenther, 809 N. Merril Ave., Park Ridge, Ill. 60068; Melvin Kerstein, 6814 N. Kolmar, Lincolnwood, Ill. 60646

[21] Appl. No.: 786,074

[22] Filed: Oct. 31, 1991

[51] Int. Cl.[5] ..... B65H 3/04

[52] U.S. Cl. ..... 271/35; 271/259; 271/270

[58] Field of Search ..... 271/35, 94, 182, 150, 271/151, 270, 3.1, 259, 265

[56] References Cited

U.S. PATENT DOCUMENTS

| | | | |
|---|---|---|---|
| 3,724,840 | 4/1973 | Kuckhermann | 271/182 X |
| 3,754,754 | 8/1973 | Peterson . | |
| 3,857,559 | 12/1974 | McInerny . | |
| 3,869,117 | 3/1975 | Yoshimura | 271/35 X |
| 3,970,298 | 7/1976 | Irvine et al. . | |
| 4,522,385 | 6/1985 | Stefansson . | |
| 4,555,103 | 11/1985 | Larson | 271/35 |
| 4,579,332 | 4/1986 | Larson | 271/35 |
| 4,709,911 | 12/1987 | Saiki et al. . | |
| 4,772,004 | 9/1988 | Golicz | 271/35 X |

FOREIGN PATENT DOCUMENTS 829719 3/1960 United Kingdom .

*Primary Examiner*—Richard A. Schacher

*Attorney, Agent, or Firm*—Welsh & Katz, Ltd.

[57] ABSTRACT

An Apparatus for separating and advancing documents includes a moving element for frictionally engaging and advancing one of the documents along a path, and a stationary element for frictionally engaging and halting the advance of the remainder of the documents. The moving element and the stationary element each include a plurality of belts and are disposed in relative juxtaposition whereby the one document is gripped between the moving element and the stationary element and advanced along the path under the influence of the moving element. The moving element and the stationary element contact the first and second surfaces, respectively, of the one document via the respective belts to provide a column strength to the one document over a substantial surface area of the document as the one document advances through the apparatus, thereby preventing portions of the one document from being crimped between the moving element and the stationary element.

17 Claims, 5 Drawing Sheets

62
64
66
96
98
100
52
30
108
146
114
116
118
56
54
38
120
60
58
46
144
47
40
150
148
42
10
48
12
36
34
44
28

BELT SEPARATOR FOR DOCUMENT SINGULATION

BACKGROUND OF THE INVENTION

The present invention relates to automated sorting apparatus used to rapidly handle and sort large volumes of documents, and specifically to an apparatus for separating single pieces of so-called "flat mail" from large groups of such mail, even in situations when the mail is randomly collated as to size and type.

Flat mail, or "flats" are terms used to refer to mail other than normal letter-sized mail, and includes magazines, large mail, and thin mailer sheets which are folded over in half, thirds, or quarters, and fastened by a staple, tape, adhesive. Presently, such mail requires a significant amount of handling by Postal Service personnel, due to the inability of commonly available automated mail handling equipment to quickly separate individual pieces of flat mail for reading and subsequent sorting.

Flats, as well as letter-sized mail, are usually fed in horizontal stacks of vertically oriented pieces to automated machinery, which separates or singulates individual pieces from the stack, positions each piece for manual or automatic reading of the Zip Code, and subsequent sorting of each piece to a bin corresponding to the Zip Code or a portion thereof, such as the last three digits. Regardless of whether the reading is done manually or automatically, the separation equipment must properly separate and position each document for fast and efficient reading without jamming. Also, the passage of "doubles", or two pieces temporarily stuck together, through the separation path is to be avoided.

Conventional equipment has the tendency to damage or mutilate certain flat mail during the separation process. For example, folded over pieces and magazine pages are often skewed and torn by being subjected to uneven roller or belt pressures, larger mail pieces are often creased, crumpled or inadvertently folded, and smaller pieces sometimes temporarily adhere to larger ones. These and similar problems of damaged flat mail require frequent manual attention by Postal Service personnel to clear jams caused by mutilated pieces becoming caught in the machine and holding up the sorting process.

Various systems have been proposed for providing trouble-free and rapid automatic separation, singulation, and sorting of flats. One such prior system employs suction cups attached to pivoting arms which grab individual pieces of mail from a vertical stack and pull them across a flat conveyor surface for subsequent reading. Other proposed systems employ vacuum heads, some also provided with specially designed suction cups, to more effectively grab and convey individual pieces of flat mail with minimum damage. However, to date, none of the proposed systems have met the required design parameters of high speed, versatility in handling a wide variety of mail, reliability, ease of operation, and low installation and maintenance costs.

Thus, there is a need for an apparatus which rapidly separates and singulates flat mail with a relatively simple yet effective configuration. There is also a need for such an apparatus which grips mail pieces of all sizes over a substantial surface area of each piece for rapid transmission along the separation path to prevent crimping of the mail piece. There is also a need for such a separator which accommodates pieces of flat mail of varying thicknesses, from thick magazines to single sheets, without jamming. Lastly, there is a need for a flat mail separator which is capable of separating as many as 10,000 pieces of mail per hour.

SUMMARY OF THE INVENTION

Accordingly, the present invention provides a flat mail separator and singulation apparatus which meets the above-identified needs by receiving an array of shingled documents from a document feeder, holding the shingled array at an entrance nip, separating a single document from the shingled array, and advancing that separated document in a vertically oriented position along a document path at high velocity for effective reading, while providing the separated document with column support. Once the first separated document is passed into the path, each subsequent document is singled out for rapid passage through the apparatus and is similarly processed.

More specifically, the present belt separator apparatus includes a moving element for frictionally engaging and advancing one of the plurality of shingled documents along a path, and a stationary element for frictionally engaging and halting the advance of the remainder of the plurality of documents. The moving element and the stationary element each include a plurality of belts, and are disposed in juxtaposition whereby the one document is gripped between the moving element and the stationary element and advanced along the path between the two elements under the influence of the moving element.

The belts of the moving and stationary elements in a preferred embodiment are vertically spaced relative to each other such that they are interleaved, and contact the front and back surfaces, respectively, of the one document to provide a column strength to the one document over a substantial surface area as the document advances through the apparatus. Additionally, this structure results in lower normal forces applied to each mail piece, which enables reliable singulation and gentle mail handling. In this manner, portions of the one document are prevented from being crimped between the moving element and the stationary element by denying the document lateral space where a crimp could form.

The apparatus includes an accelerator mechanism for inducing a high velocity to the one document in the path to complete the separation of the document from the shingled array. The one document is subsequently passed to additional handling equipment. Once the first document of the shingled array is advanced along the path, each document of the array is similarly advanced seriatim. In addition, a sensing mechanism is provided to monitor the number of documents in the apparatus and to control the document feeder appropriately to maintain a steady flow of shingled documents into the apparatus.

DESCRIPTION OF THE PREFERRED EMBODIMENT

Figure 1:
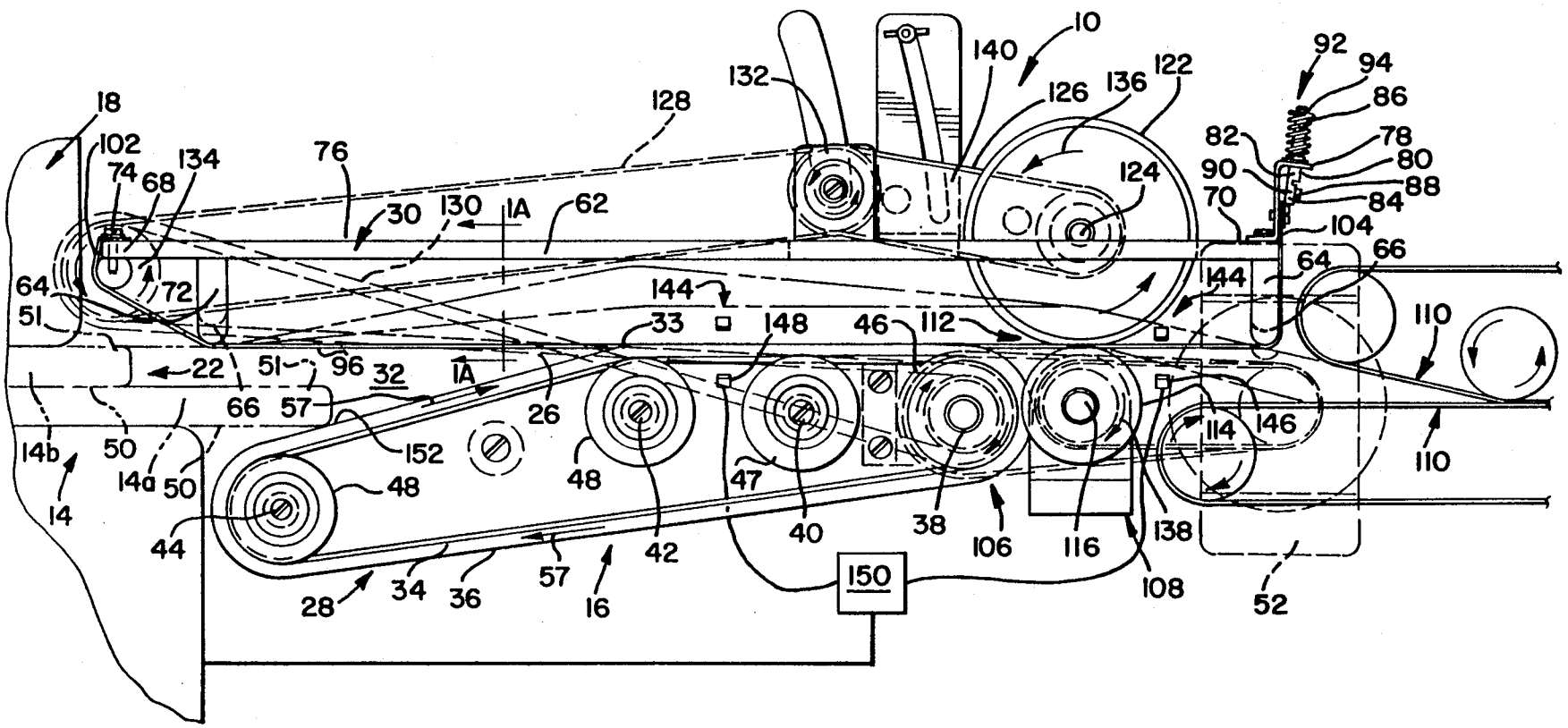
FIG. 1 is an overhead plan view of the belt separator of the invention.
Figures 1A, 2:
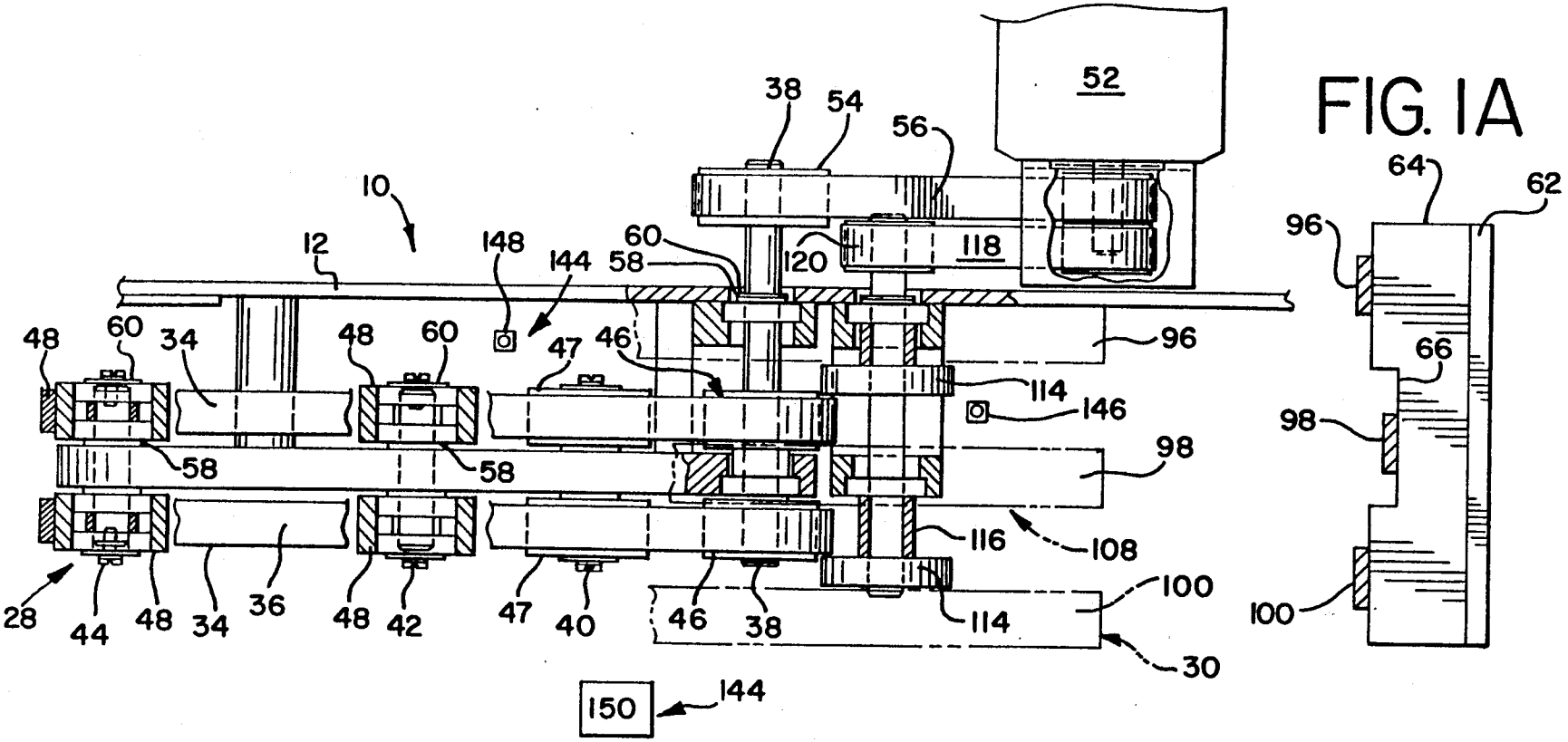
FIG. 1A is a section taken along the line A—A of FIG. 1 and in the direction indicated generally.
FIG. 2 is a front elevational view of the apparatus of FIG. 1 in partial section.

Referring now to FIGS. 1, 1A, and 2, the belt separator apparatus of the present invention is generally indicated at 10. The separator 10 includes a support frame 12 preferably having a configuration which facilitates integration with other conventional mail handling and sorting apparatus. In FIGS. 1 and 2, pieces of flat mail, generally designated 14, are advanced in a left-to-right direction as seen from a front 16 of the separator 10.

A document feeder 18 is located just to the left of the apparatus 10 and is contemplated to be any one of various designs well known to skilled practitioners. However, a preferred feeder 18 (best seen in FIG. 3) includes at least one conically shaped shingling disc 19 which rotates axially in the direction indicated by the arrow 20 to drive documents disposed on edge in the direction shown by the arrow 23. The document feeder 18 receives horizontal stacks of vertically positioned flat mail pieces 14, each of which is oriented so that the addressed side faces the front 16 of the separator 10. Through the action of the disc 19 and the backup roller or bumper 21, the feeder 18 creates a shingled array 22 of the leading several pieces or documents 14 of flat mail, designated 14*a* and 14*b*, respectively, which are shingled so that the front-most document 14*a* is advanced at a faster velocity than the subsequent document 14*b* in the shingled array. Although only two shingled documents 14 are depicted in FIG. 1; it will be appreciated that additional documents are normally provided in the array 22.

The shingled array 22 encounters the separator 10 by being advanced into a path 26 defined by a moving element 28 and a stationary element 30. An entrance portion 32 of the path 26 is wedge or triangular shaped as viewed from above, due to the relative distances between corresponding portions of the moving element 28 and the stationary element 30. To the right of the entrance portion 32, and beginning at an entrance nip 33, the path 26 is generally linear through the rest of the separator 10.

The moving element 28 is designed for frictionally engaging and individually advancing each one of the documents 14 in the shingled array 22 along the path 26, while the stationary element 30 is designed for supporting each advanced document 14*a*, and also for frictionally engaging and halting the advance of the remaining documents, represented by the document 14*b*, such that only one document at a time is passed through the separator 10. Stationary element 30 provides the normal force to hold the document against moving element 28, causing the document to advance through the separator 10. The element 28 preferably includes a pair of document drive belts 34, which are made of resilient, durable material and preferably have a textured outer surface 36 to enhance friction contact between the belts 34 and the documents 14. Although only two drive belts 34 are provided, depending on the application and size of the apparatus 10, additional drive belts are contemplated The drive belts 34 are disposed in vertically spaced, parallel orientation relative to each other around a drive spindle 38 and three idler spindles respectively designated 40, 42, and 44. The drive spindle 38 has a pair of vertically spaced drive rollers 46, the idler spindle 40 has a correspondingly spaced pair of rollers 47, and each of the idler spindles 42, 44 has a correspondingly spaced pair of idler rollers 48. The belts 34 extend around the rollers 46, 47, 48. The belts 34 of the moving element 28 thus define a vertical contact surface for engaging a front surface 50 of each of the documents 14. A motor 52 drives the spindle 38 through a pulley 54 and a drive belt 56 so that the drive belts 34 follow a clockwise movement indicated by the arrows 57.

In the preferred embodiment, the spindles 38, 40 and 42 are disposed in a generally linear, regularly spaced arrangement. However, the diameter of rollers 47 is larger than the diameter of the rollers 48 mounted on spindles 38 and 42. This configuration extends the central position of belts 34 outward as they pass adjacent stationary element 30, thereby increasing the frictional contact between the belts 34 and the documents 14 as the documents pass through this portion of separator 10.

The spindle 44 is linearly and spatially displaced and slightly offset forwardly from the other spindles to define the generally triangular shape of the entrance portion 32. Thus, at the spindle 44, the moving element 28 is at a first, relatively distant position relative to the stationary element 30, while at the spindles 38, 40, 42, the moving element and the stationary element are in closely adjacent, contacting relationship with each other. All of the spindles 38, 40, 42 and 44 are mounted to the frame 12 by brackets 58 equipped with bearings 60 as are well-known to skilled practitioners.

The stationary element 30 includes a support plate 62 secured to the frame 12 and equipped with a pair of vertically extending members 64, which extend outward from plate 62 at right angles, as seen in FIG. 1. The plate 62 has a first end 68, located on the left in FIGS. 1 and 2, and a second end 70, located on the right in FIGs. 1 and 2. Each of the vertical members 64 is located closely adjacent a respective one of the first and second ends 68, 70.

A substantially cylindrical, vertically oriented post 72 is secured to the first end 68 of support plate 62, and three vertically spaced belt fastening points 74 (only the uppermost being visible in FIG. 1) are disposed on a rear side 76 of the support plate 62 opposite the post 72. At the second end 70, three vertically spaced, generally "S" - shaped, belt end retaining brackets 78 (only the uppermost being visible) are secured to the rear side 76 of support plate 62, with each bracket being in generally horizontal alignment with a corresponding belt fastening point 74 on the first end 68. Each bracket 78 has an opening 80 through which a pin 82 reciprocally extends, the pin having an attachment end 84 and a biased end 86.

At the attachment end 84, a set screw 88 or other releasable fastener is threaded into a tongue 90. At the biased end 86, a spring clip 92 secured to the end of the pin 82 retains a coiled spring 94 against the bracket 78. In this manner, the pin 82 is biased away from the front 16 of the separator 10.

The support plate 62 is provided with three hold back belts 96, 98, 100, which are mounted horizontally, facing the front 16 of the separator 10, and in generally vertically spaced relationship relative to each other to correspond with the belt fastening points 74 on the first end 68 of the beam, and the corresponding brackets 78 on the second end 70 of the beam. For each belt 96, 98, 100, a first end 102 is wrapped around the corresponding vertical member 64 and the post 72 to avoid creasing or folding, and is secured to the rear side 76 of the plate 62 at the corresponding belt fastening point 74. A second end 104 of each belt 96, 98, 100 is wrapped around the opposite corresponding vertical member 64 and secured to a corresponding one of the pins 82 by the set screw 88 in the tongue 90. In this manner, the springs 94 maintain a predetermined tension on the belts 96, 98, 100 which keeps them taut, yet provides slack when the force of spring 94 is overcome, such as when a thick document is advanced along the path 26.

In the preferred embodiment, the upper and lower belts 96 and 100 define a generally vertical plane which is substantially parallel to the plane defined by the drive belts 34. The middle belt 98 is slightly recessed from that plane by virtue of its disposition in the notches 66. In one embodiment, it is also preferred that the middle belt 98 have a coefficient of friction ($\mu$) which is distinct from the coefficient of friction $\mu$ of the upper and lower belts 96, 100.

In one preferred embodiment, the $\mu$ of the upper and lower belts 96, 100 will be lower than that of the recessed center belt 98, thus making it easier for a document to glide along the upper and lower belts compared to the central belt 98. It is also contemplated, however, that the center belt 98 may in some cases have a lower relative $\mu$ than the upper and lower belts 96, 100.

The differential in the $\mu$ of the hold back belts 96, 98, 100 is useful due to the fact that these belts perform three basic functions: a) they offer a lateral normal force for the drive belts 34 to work against; b) they constrain and support the pieces of flat mail 14 with a column strength so they cannot roll or be folded, bent or crumpled; and c) they provide a hold back force so that "doubles" or two documents temporarily stuck together will not proceed past the nip 33.

The leftmost vertically extending member 64, as viewed in FIG. 1, includes a centrally located recess or notch 66, best seen in FIG. 1A. This notch is not formed in the rightmost member 64. The left end of center belt 98 extends across notch 66, whereby the surface of the left end of belt 98 extending between the forward end of the left member 64 and nip 33 is rearward of the plane defined by belts 96 and 100, such that center belt 98, with its higher coefficient of function, does not contact document 14*a* as the document advances toward nip 33. This eliminates the possibility of belt 98 disadvantageously applying a hold-back force to document 14*a* in opposition to the forces applied by belt 36. At nip 33, all three belts 96, 98, 100 are co-planar, and a hold back force is applied by belt 98, and belts 96 and 100, in the region of belt separator 10 beyond, or to the right of nip 33, as viewed in FIG. 1.

Regardless of the respective $\mu$ of the belts 96, 98, 100, the moving element drive belts 34 have a higher $\mu$ on the outer surface 36 than the highest $\mu$ of any of the belts of the stationary element 30. This relationship is important to enable the drive belts 34 to overcome the holding force of the hold back belts 96, 98, 100 and to advance documents along the path 26.

Referring again to FIGS. 1 and 2, it will become evident that while the belts 34 of the moving element 28 define a first vertical planar contact surface, and the belts 96, 98, 100 of the stationary element 30 generally define a second vertical planar contact surface, the relative spacing of the moving belts 34 and the hold back belts 96, 98, 100 is such that the belts of the moving element are located in a vertical orientation between the belts of the stationary element, and never contact the belts of the stationary element. This relationship is designed to reduce wear on the moving belts 34 when documents 14 are not being advanced along the path 26, which would otherwise occur if the belts of the moving and stationary elements 28, 30 were positioned in opposing, contacting relationship.

It will also be evident from FIG. 1 that a portion 106 of the moving element 28 defined by the portion of belt 34 extending adjacent spindles 38, 40 and 42 is positioned so that the belts 34 project across the path 26 and past the plane defined by the belts 96, 98, 100. This is due to the fact that the diameter of roller 47 mounted on spindle 40 is greater than the diameter of the rollers 48 mounted on spindles 38 and 42. This arrangement is preferred so that sufficient pressure is exerted by the belts 34 on each flat document 14 to ensure its advance along the path 26. Portion 106 of moving element 28 includes that distance substantially between nip 33 and roller 46.

An accelerator roller assembly is generally designated 108 and is positioned to engage individual flat documents 14, and initially the document 14*a*, in the path 26 to complete the separation from the shinqled array 22. The accelerator roller assembly 108 is provided to increase the velocity of the lead document 14*a* along the path 26 to be processed by additional handling equipment such as a high speed conveyor apparatus 110. In the preferred embodiment, the accelerator roller assembly 108 is mounted to the right of the moving element 28; however, other mounting positions, such as between the spindles 38 and 40 are contemplated.

The accelerator roller assembly 108 includes two opposing pairs of driven or powered rollers which straddle the path 26 to form a nip 112. The first pair of driven rollers 114 rotate on a spindle 116 mounted to support frame 12. The spindle 116 is driven by suitable power means, and is preferably disposed in generally linear alignment with the spindles 38, 40 and 42. As will be evident from FIG. 2, the rollers 114 are vertically spaced on the spindle 116 to provide the accelerated document with further column support, while being horizontally aligned not to interfere with the drive belts 34 or the hold back belts 96, 98, 100.

The second pair of accelerator drive rollers 122 rotate on a spindle 124 and are driven by the motor 52 through a series of belts 126, 128, 130, and pulleys 132 and 134. Alternatively, the spindle 124 may be driven directly by a motor (not shown). The rollers 122 are vertically spaced on the spindle 124 to correspond to the spacing of the rollers 114 on the spindle 116. The nip 112 is formed by the contacting or closely spaced relationship of the rollers 114 and 122. The rollers 114 and 122 rotate in opposite directions, as indicated by respective arrows 136, 138, and provide the driving nip 112 to engage and accelerate each document 14 as it exits separation path 26.

To accommodate relatively thicker pieces of flat mail 14 such as magazines and thick envelopes, the accelerator rollers 114, 122 are constructed so that at least one pair of rollers is spring biased to pivot away from the path 26 and allow the advancement of a thick document at increased velocity. In the preferred embodiment, the rollers 122 and the spindle 124 are mounted to a pivot arm 140 (shown hidden) secured to the frame 12, and being biased for engagement at the nip 112 by a spring (not shown) as is well known in the art.

The separator apparatus 10 is also preferably provided with a sensor system, generally designated 144, for monitoring the presence of documents 14 in the path 26 so that a relatively constant flow of documents is advanced along the path. Although the sensor system 144 may take many forms as is well known to skilled practitioners, in the preferred embodiment, the system includes a pair of photocells, 146 and 148 which are connected to a control module, shown diagrammatically at 150. The module 150 is also connected to a control element (not shown) for the document feeder 18.

The photocell 146 is preferably located just to the right of the accelerator drive roller 114 and straddles, or throws a beam across, the end of path 26 to detect a gap or spacing between documents. Such gap is indicative of a lack of documents 14 in the path 26, and a signal generated by the photocell 146 triggers a command by the control module 150 to activate the drive motor 52, thereby activating the belt 34 to drive additional documents towards accelerator roller assembly 108.

The photocell 148 is preferably located approximately one inch to the right of the entrance nip 33 and is also positioned to straddle the path 26. When each document 14 passes the photocell 148, the beam is interrupted, which generates a signal to the control module 150 to deactivate the document feeder 18. In the absence of a document, the beam is not interrupted, and the feeder advances documents 14 to the separator 10. It will be appreciated that the sensor system 144 will result in intermittent operation of the feeder 18 and a resulting intermittent feeding of documents 14 onto the path 26. However, the flow of documents along the path 26 will be relatively uniform. Furthermore, it is contemplated that other equivalent sensing devices commonly known in the art, including, but not limited to encoders, may be positioned in operational relationship to the separator 10 to achieve the above-identified relatively constant flow of documents through the separator 10.

Figure 3:
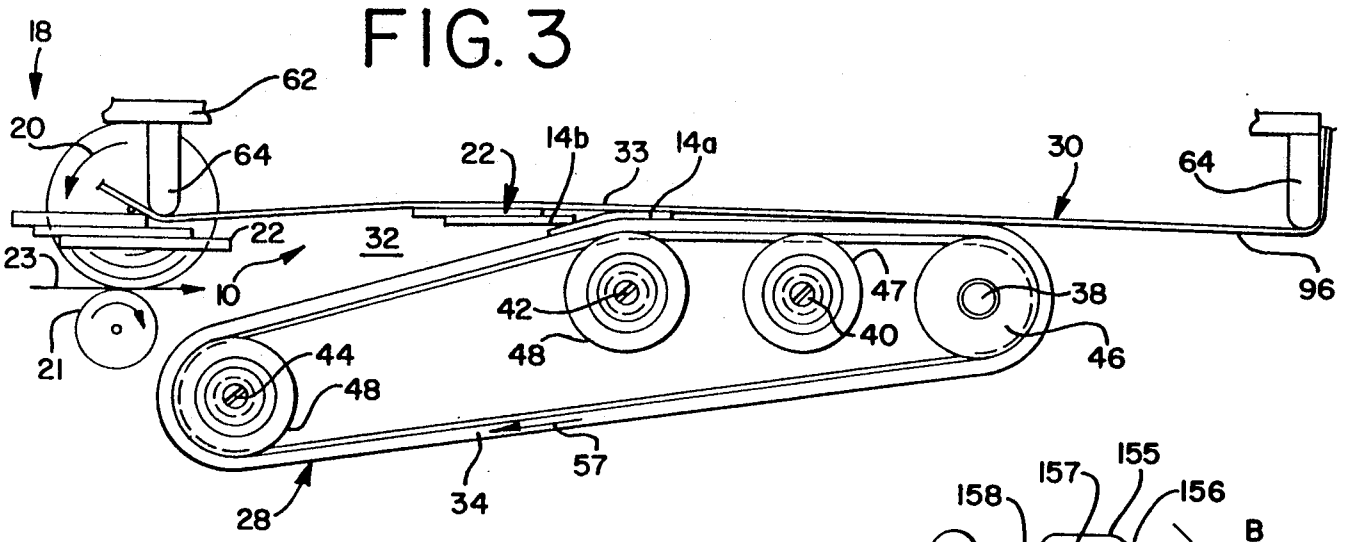
FIG. 3 is a diagrammatic overhead plan view of a representative shingled array of three documents located at the entrance nip of the present apparatus.

In operation, and referring to FIGS. 1-3, once the control module 150 is triggered to activate the document feeder 18, a shingled array 22 of documents 14 is fed into the entrance portion 32 of the separator 10. Each shingled array 22 includes a forward-most lead document **14*a* which is moving faster than subsequent documents as it reaches the entrance nip 33. At a point 152 (best seen in FIG. 1), the front surface 50 of the document 14*a* will be engaged by the outer surface 36 of both drive belts 34. Since the $\mu$ of the surface 36 is greater than the between the first document 14*a* and the second document 14*b*, the document 14*a* is pulled forward toward entrance nip 33 by the belts 34**.

During this time, the second document **14*b* and any other documents in the array 22 engage the hold back belts 96, 100 of the stationary element 30. The document feeder 18 pushes the array 22 toward the entrance nip 33. Since the document 14*a* is traveling along the path 26 at a greater velocity than the remainder of the array 22, it reaches the nip 33 first, and is advanced into the portion 106 of the moving element 28 under the influence of belt 34**.

In portion 106 of the separator 10, the disposition of the document drive belts 34 and the hold back belts 96, 98, 100 define substantially vertical, opposing planar contact surfaces which extend over a substantial planar area relative to the front surface 50 and rear surface 51, respectively, of the document **14*a* being contacted by the moving belts 34 to move the document along the path 26. Thus, both the moving and hold back belts combine to provide column strength to the documents 14 held therebetween as the documents are advanced along the path 26**. This column support prevents each document from being bent, rolled, crumpled or otherwise damaged during the separation process by retaining each document in a confined space during advancement.

As seen in FIG. 3, the hold back belts 96, 100 conform to the shape of the document array 22 due to the biased mounting of the belts 96, 98, 100 to support plate 62. This mounting arrangement provides the hold back belts 96, 98, 100 with the necessary slack to conform to documents of varying thicknesses. It will be appreciated that to achieve the desired column support, the document occupies a significant portion of the lateral space between the movable element 28 and the stationary element 30. As the initial document **14*a* passes the entrance nip 33, the position of the drive belts 34 ensures a positive engagement of the document between the moving and stationary elements 28, 30. Specifically, the drive belts 34 extend rearwardly across the path 26 into the plane defined by the hold back belts 96, 98 and 100**.

Furthermore, the positioning of the idler roller 48 on the spindle 42 provides a normal force which exerts a pressure on the held back document **14*b* which causes it to be engaged by the center hold back belt 98. This belt preferably has a higher $\mu$ than the hold back belts 96 and 100, and exerts a holding force on the document 14*b*, as well as any other documents in the array 22, as illustrated in FIG. 3**.

Additionally, the larger diameter of rollers 47 mounted to spindle 40 forces belts 34 toward hold back belts 96, 98, and 100 to provide additional normal force along the operative length of belts 34 at portion 106 of the moveable element 28. This prevents slack in belts 34 between nip 33 and the drive roller 46, and maintains belts 34 in engagement with document **14*a***.

Once the initial document **14*a* is advanced through the portion 106 of the separator 10, the moving drive belts 34 contact the front surface of document 14*b* and overcome the holding force of the hold back belt 98 to advance the document 14*b* into the path 26 in the same manner as the document 14*a*. Each document 14 in the shingled array 22 will be similarly advanced seriatim through the separator 10 until, with the passage of the last document, a gap is sensed by the photocell 146 to trigger the feeder 18 to advance another array 22 to the entrance nip 33. The documents 14 can be continually or intermittently fed through separator 10**, depending upon the requirements of the equipment downstream of the separator.

Figure 4:
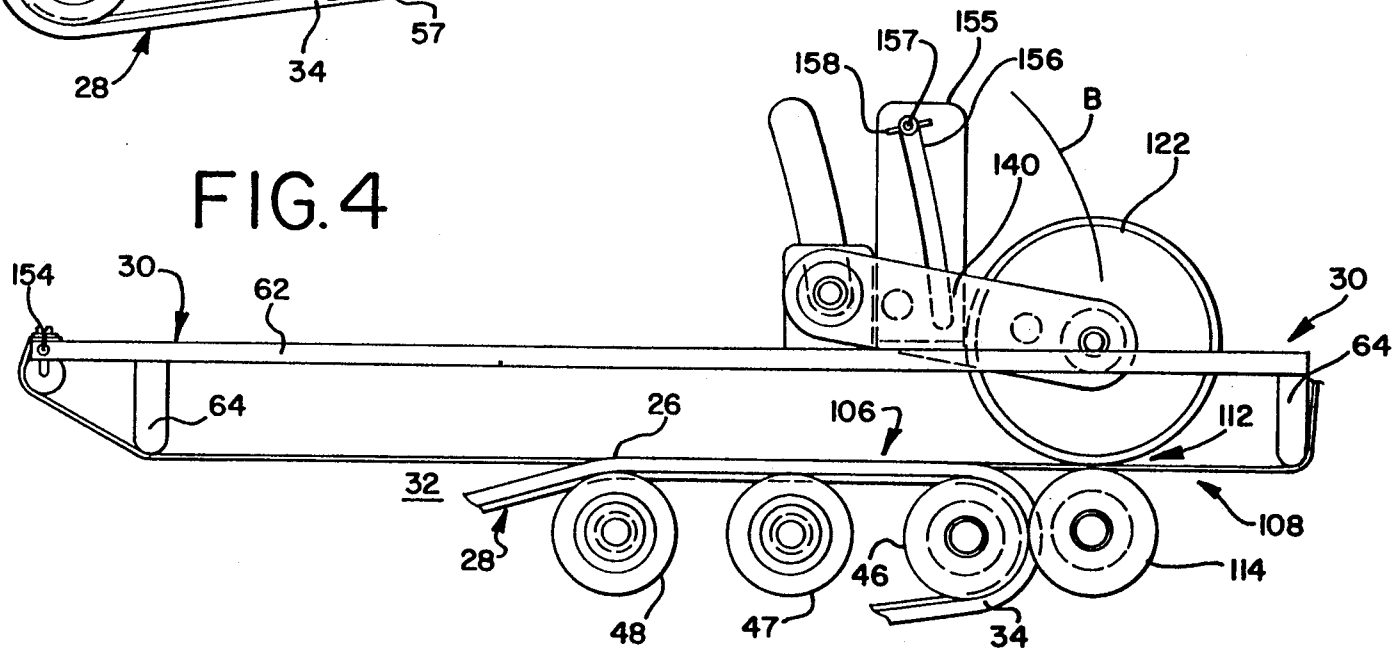
FIG. 4 is a diagrammatic overhead plan view of the apparatus of FIGS. 1 and 2.

Referring now to FIG. 4, an additional feature of the separator 10 is shown. This feature relates to the pivotability of the plate 62 about a shaft 154 and is designed to facilitate the clearing of jammed documents 14 from the path 26. The plate 62 is preferably configured to be movable in an arc B away from the document path 26. This pivotal action of the plate 62 is controlled through a bracket 155 which projects rearwardly from the plate, and which has an angled or arcuate slot 156. A threaded stud 157 attached to the frame 12 projects through the slot 156 and is dimensioned so that the slot slidinqly engages the stud as the arm 62 pivots about the shaft 154 along the arc B. During normal operation, a wingnut 158 is threaded upon the stud 157 to secure the bracket 155 and the plate 62 in stationary position.

Thus, upon a jam occurring in the path 26, and especially in the second portion 106, upon loosening the wingnut 158, the entire stationary element 30 may be displaced through the arc B from its operational position to permit access by machine operators. The accelerator roller 122 and the pivot arm 140 are independently pivotable in relation to the plate 62. This feature permits the stationary element 159 to pivot in an arc away from the path 26 to accommodate unusually thick documents, while still maintaining contact through the hold back belts 96, 98 and 100. As in the case with the separator 10, the accelerator roller 122 and the pivot arm 140 will still be pivotable in relation to the beam 156.

Figure 5:
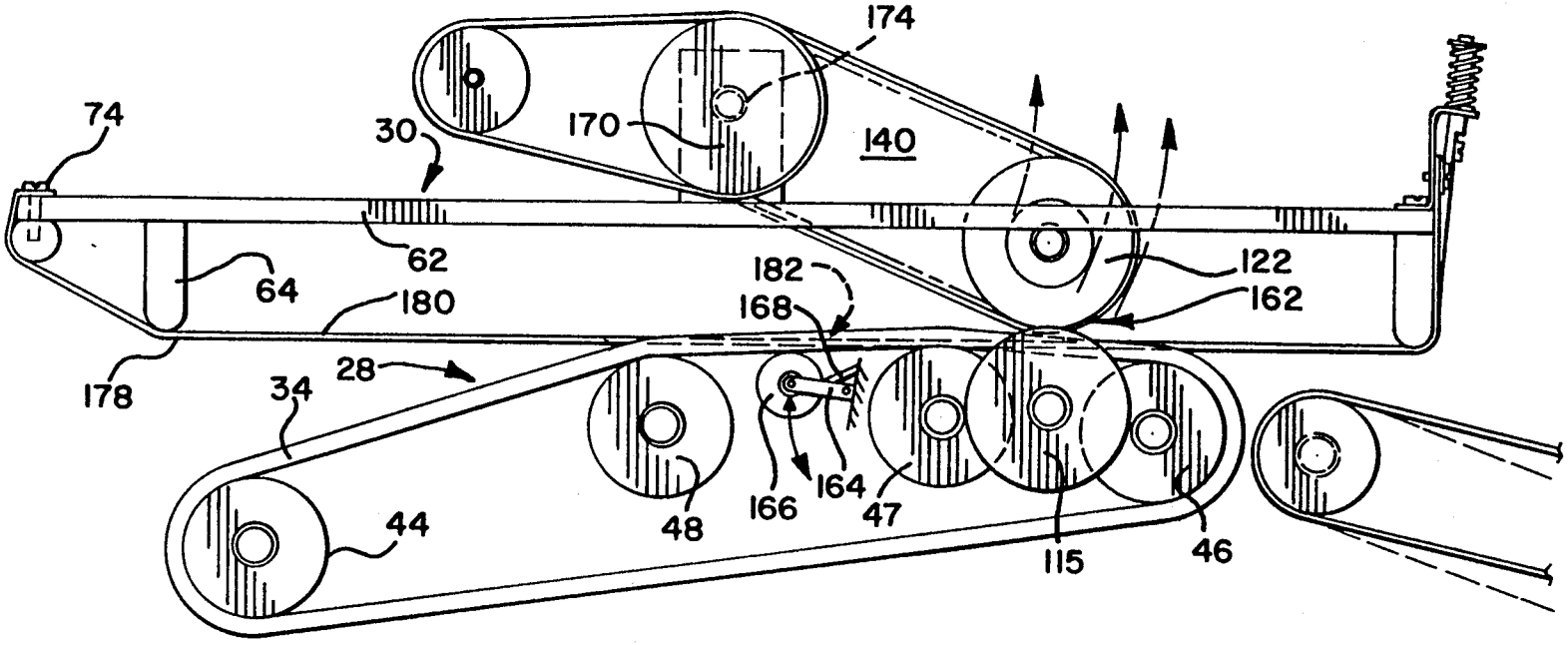
FIG. 5 is a diagrammatic overhead plan view of an alternate embodiment of the apparatus of FIGS. 1 and 2.

Referring now to FIG. 5, an alternate embodiment of the separator 10 is generally indicated at 160. The components of the separator 160 which are identical to the components of the separator 10 have been designated by identical reference numerals. The separator 160 includes a modified accelerator assembly 162. In order to engage the lead document 14*a* when it is still constrained by the belt systems constituting moving element 28 and stationary element 30, the assembly 162 is mounted within the section 106 of the moving element 28 and just to the left of the drive roller 46, as seen from above.

Driven rollers 115 (FIG. 5) are disposed in the same vertically spaced position a the rollers 114 (FIGS. 1, 2); however, the rollers 115 are located between rollers 46 and 47. Drive rollers 123 are connected to the pivot arm 140 and are vertically spaced to drive rollers 115 in similar fashion to the manner in which rollers 114 are driven by rollers 122, thus creating nip 112.

Also included in the assembly 162 is a biased pivot arm 164 mounted to the frame 12 between the rollers 47 and 48. A pair of document release rollers 166 are mounted to the pivot arm 164 so as to be vertically spaced to correspond to the vertical spacing of the rollers 114 (best seen in FIG. 2). Suitable spring means bias the rollers 166 in a direction away from document path 26, as seen in FIG. 5, but to a position where the circumference of rollers 166 remains in contact with the moving document 14 in the path 26. As an alternative, the rollers 166 may have any equivalent spacing which provides column support for the documents in the path 26, and which also does not interfere with the respective belts of the moving element 28 and the stationary element 30. The pivot arm 164 is pivotally moveable about pin 167, and is mechanically controlled as is known in the art, for example by a solenoid 168, and is triggered, such as by the photocell 146, to be activated only when the accelerator 162 is advancing a document 14 along the path 26.

The accelerator 162 may be operated by its own motor 170 through a belt 172 and pulley 174 and may be controlled by a photocell 176 or other equivalent sensing system which monitors the presence of a document advancing along the path 26 past the roller 47 of the moving element 28. In applications when the motor 170 is provided, the pivot arm 164 is preferably operated in conjunction with the accelerator motor 170. The tangential velocity of rollers 123 and 115 are maintained uniform through suitable control means.

When a shingled array 22 of documents 14 is advanced onto the path 26 of the separator 160, the first document 14*a* is advanced initially into the section 106 of the moving element. Once the leading edge of document 14*a* is advanced past the section 106 under the influence of accelerator 162, and specifically past the rollers 46, the sensor 146 sends a signal whereby the drive motor driving belt 34 is de-energized. Simultaneously with this operation, the pivot arm 164 is energized in a clockwise direction, as viewed in FIG. 5. In this manner, the document release rollers 166, which in a deactivated position rollingly contact documents passing along the path 26, now urge the document 14*a* out of engagement with the drive belts 34 such that the document's acceleration is not hampered by frictional contact with the slower moving drive belts 34. Once the document has been accelerated, such operation being sensed by a gap at either the photocells 176 or 146, the accelerator 162 is deenergized and the pivot arm 164 moves the rollers 166 counterclockwise and out of engagement with the path 26.

Another feature of the separator 160, which may be employed in association with the other described embodiments, is that the hold back belts, all three of which are generally designated 178 in FIG. 5, can be manufactured of a material which provides a lower $\mu$ from the attachment point 74 to the entrance nip 33, such portion being designated 180. The belts 178 are also provided with a relatively higher $\mu$ from the nip 33 moving to the right at least until the end of the portion 106 of the moving element 28, this portion being designated 182. Thus, the hold back belts 178 have an inherent hold back capability at the location 180 in the separator 160 where the documents need to be held, while facilitating the slidability of the documents along the path 26 until that point is reached. Past the entrance nip 33, the moving force of the drive belts 34 will overcome the higher $\mu$ of the portion 182 of the belts 178.

Figure 6:
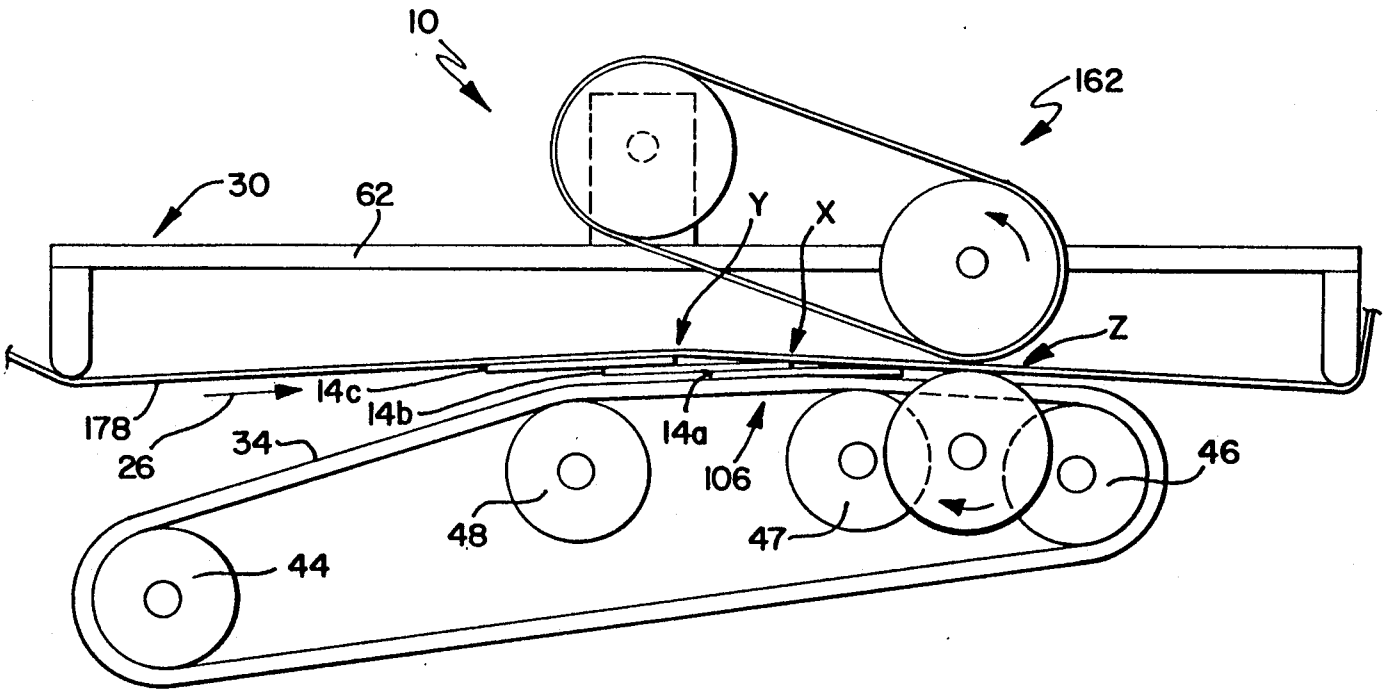
FIG. 6 is a diagrammatic representation of one selected feature of the present apparatus.

FIG. 6 illustrates an additional advantage provided by the extended tangential point of contact between documents 14 and belts 34 as the belts pass over rollers 47. As set forth previously, in the preferred embodiments, the diameters of rollers 47 are larger than the diameters of rollers 46 and 48. If preferred, rollers 47 could be the same diameter as rollers 46 and 48, with shaft 40 being relocated in an upward direction, as viewed in FIG. 1. Thus, the point of contact between belts 34 as they pass over rollers 47 is above an imaginary line drawn between the points where belts 34 contact rollers 46 and 48.

In FIG. 6, the relationship between relevant elements is shown in exaggerated form for clarity of explanation. In the condition of operation shown, three shingled documents 14*a*, 14*b* and 14*c* have advanced along document path 26 just beyond (to the right of) rollers 48. Rollers 47 have urged belt 34 in region 106 toward hold back belts 178, and belt 34 has engaged one surface of envelope 14*a*, and is advancing envelope 14*a*towards accelerator roller assembly 162. The diameter of rollers 47 urges hold back belts 18 into a curved configuration, as shown in FIG. 6. Due to the curve in hold back belts 178, the leading edge of second envelope 146 engages the hold back belts at point x, and the leading edge of envelope 14*c* engages the hold back belts at point y. The contact between envelopes 14*b* and 14*c* at points x and y, respectively, applies a hold back force on these envelopes. Due to the curvature in hold back belts 178 provided by roller 47, envelopes 14*b* and 14*c* are restrained before they reach accelerator roller assembly 162. It has been determined that in the absence of rollers 47, the point of contact between the leading edge of envelopes 14*b* and 14*c*, and hold back belts 178 might occur at point z, which is beyond the nip of the accelerator rollers. Therefore, under the conditions illustrated in FIG. 6, this condition would lead to the possibility of multiple documents being fed through the singulator device 10, which is undesirable. Therefore, as explained above, one purpose of the use of rollers 47 is to move the hold back point of contact between envelopes 14*b* and 14*c*, and hold back belts 178, to the left as viewed in FIG. 6 to a location well ahead of the accelerator roller assembly 162.

While particular embodiments of the separator of the present invention has been shown and described, it will be appreciated by those skilled in the art that changes and modifications may be made thereto without departing from the invention in its broader aspects and as set forth in the following claims.

What is claimed is:

1. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document;

said fixed belt means comprising a plurality of stationary belts extending adjacent said path, said movable element comprising a plurality of movable belts whereby each of said movable belts has a portion extending adjacent said path, said portion of each of said movable belts being disposed adjacent one of said stationary belts.

2. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document, said fixed belt means comprising a plurality of stationary belts extending adjacent said path, said stationary belts being located apart from each other in vertically spaced relationship and defining spaces between each of said stationary belts, said movable element comprising a plurality of movable belts disposed in vertically spaced relationship to each other, whereby each of said movable belts has a portion thereof which extends adjacent said spaces between said stationary belts.

3. An apparatus for separating and advancing documents, said apparatus comprising;

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document;

support means extending adjacent said path, said fixed belt means resiliently mounted to said support means to provide for lateral movement of said fixed belt means as said one document moves along said path in the grip of said movable element and said fixed belt means.

4. The apparatus of claim 3 including spring means mounting said fixed belt means to said support means.

5. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document;

support means extending adjacent said path, said fixed belt means resiliently mounted to said support means to provide for lateral movement of said fixed belt means as said one document moves along said path in the grip of said movable element and said fixed belt means;

said support means being pivotally mounted to said apparatus, whereby said fixed belt means moves in an arc away from said movable element under the influence of a thick document being transported along said path such that said fixed belt means and said movable element remain in contact with said thick document.

6. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document;

said fixed belt means comprising at least one fixed belt having a first coefficient of friction, and at least one additional fixed belt having a second coefficient of friction.

7. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document;

said fixed belt means comprising first and third belts spaced apart from each other with each belt having a first coefficient of friction, and a second belt extending between said first and third belts, said second belt having a higher coefficient of friction than said first and third belts.

8. The apparatus of claim 7 wherein said fixed belt means comprises first, second and third belts in vertically spaced relationship to each other, said second belt comprises an initial portion which is recessed from a vertical plane defined by said first and third belts, whereby said second belt means does not contact said second surface of said document over said initial portion.

9. The apparatus of claim 8 wherein at least one of said belts has a first linear portion with a first coefficient of friction, and a second linear portion with a second coefficient of friction, said first portion having a lower coefficient of friction than said second portion.

10. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said stationary element including fixed belt means extending adjacent said path for supporting said one document;

said fixed belt means comprising first and third belts spaced apart from each other and each belt having a first coefficient of friction, and a second belt extending between said first and third belts, said second belt having a lower coefficient of friction than said first and third belts.

11. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar ares to provide a column strength to said one document over a substantial surface area of said document as said one document advances through said apparatus, thereby preventing portions of said one document from being crimped between said moving element and said stationary element;

accelerator means operationally disposed relative to said moving element for engaging said one document as said one document advances along said path and for increasing the velocity of said one document along said path.

12. The apparatus of claim 11, wherein said accelerator means includes at least one accelerator roller pivotally disposed relative to a second driven roller to define a nip for engaging said one document in said path.

13. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

accelerator means operationally disposed relative to said moving element for engaging said one document s said one document advances along said path and for increasing the velocity of said one document along said path;

wherein said accelerator means includes at least one accelerator roller pivotally disposed relative to a second driven roller to define a nip for engaging said one document in said path; and disengaging means associated with said accelerator for disengaging said one document from said movable element upon a portion of said document being engaged by said accelerator means.

14. The apparatus of claim 13 wherein said disengaging means includes a pivot arm having at least one document release roller on an end thereof for engaging said one document.

15. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of planar abreast to provide a column strength to said one document over a substantial surface area of said document as said one document advances through said apparatus, thereby preventing portions of said one document from being crimped between said moving element and said stationary element;

said moving element comprising movable belt means having a first portion defining a document entrance means, and a second portion for applying a force to said one document to grip said one document between said second portion of said movable belt means and said stationary element;

first sensing means for sensing an absence of documents in the path;

second sensing means for sensing when said plurality of documents is located at said entrance means.

16. The apparatus of claim 15 further including control means connected to said first sensing means, said second sensing means, and the document feeder for delivering a second plurality of documents in shingled array to said apparatus upon the sensing of the advancement of said last document through said apparatus by said first sensing means, and for interrupting the delivery of documents to said apparatus upon the sensing of the advancement of said last document through said apparatus by said first sensing means, and for interrupting the delivery of documents to said apparatus upon the sensing of a plurality of documents at said entrance means by said second sensing means.

17. An apparatus for separating and advancing documents, said apparatus comprising:

a moving element for frictionally engaging and advancing one of said documents along a path;

a stationary element for frictionally engaging and halting the advance of the remainder of said documents;

said moving element and said stationary element being disposed in juxtaposition whereby said one document is gripped between said moving element and said stationary element and advanced along said path under the influence of said moving element;

said moving element including first contact surface means which extend over a first substantial planar area relative to a first surface of said one document being contacted by said moving element;

said stationary element including second contact surface means which extend over a second substantial planar area relative to a second surface of said one document being contacted by said stationary element;

said moving element and said stationary element contacting said first and second surfaces, respectively, of said one document over said first and second substantial planar areas to provide a column strength to said one document over a substantial surface area of said document as said one document advances through said apparatus, thereby preventing portions of said one document from being crimped between said moving element and said stationary element;

said moving element comprising movable belt means having a first portion defining a document entrance means, and a second portion for applying a force to said one document to grip said one document between said second portion of said movable belt means and said stationary element;

said second portion of said movable belt means extending around a drive roller and a plurality of idler rollers, one of said idler rollers applying a force to said second portion of said belt means which extends said second portion of said belt means towards said stationary element to enhance the gripping of said one document by said movable belt means and said stationary elements;

said one idler roller also extending said second portion of said belt means toward said stationary element to form a curvature in said stationary element whereby said curvature in said stationary element engages a leading edge of all documents except a leading document of a plurality of documents advancing along said path, and holds back all documents except said leading document from advancing along said path.

* * * * *

UNITED STATES PATENT AND TRADEMARK OFFICE

CERTIFICATE OF CORRECTION

PATENT NO. : 5,257,777

DATED : November 2, 1993

INVENTOR(S) : Kalika, et al.

It is certified that error appears in the above-indentified patent and that said Letters Patent is hereby corrected as shown below:

In the specification:

Column 3, line 68, insert -- . -- after "contemplated."

Column 7, line 52, insert -- u -- after "the"

Column 8, line 66, change "slidinqly" to -- slidingly --

Signed and Sealed this

Thirty-first Day of October 1995

*Attest:*

*Attesting Officer*

BRUCE LEHMAN

*Commissioner of Patents and Trademarks*